US005103468A

United States Patent [19]

Banholzer et al.

[11] Patent Number: 5,103,468

[45] Date of Patent: Apr. 7, 1992

[54] ELECTROMECHANICAL COUNTING DEVICE WITH UNINTENTIONAL COUNT PREVENTION STRUCTURE

[75] Inventors: Kurt Banholzer, Dauchingen; Fritz Kübler, VS-Schwenningen, both of Fed. Rep. of Germany

[73] Assignee: Ing. Fritz Kübler zählerfabrik GmbH, Schwenningen, Fed. Rep. of Germany

[21] Appl. No.: 583,856

[22] Filed: Sep. 14, 1990

[30] Foreign Application Priority Data

Sep. 16, 1989 [DE] Fed. Rep. of Germany ..... 3930976

[51] Int. Cl.[5] ..... G06M 1/10

[52] U.S. Cl. ..... 377/90; 377/91; 377/92; 377/28

[58] Field of Search ..... 377/82, 90, 91, 92, 377/28; 235/131 R, 133 A

[56] References Cited

U.S. PATENT DOCUMENTS

| | | | |
|---|---|---|---|
| 2,857,101 | 10/1958 | Hoffmann et al. | 377/92 |
| 3,138,030 | 6/1964 | Godel | 235/131 R |
| 3,580,498 | 5/1971 | La Pointe | 377/82 |
| 3,648,028 | 3/1972 | Hara et al. | 377/82 |
| 3,761,015 | 9/1973 | Cook | 377/92 |
| 4,250,404 | 2/1981 | Yamamoto et al. | 377/92 |
| 4,532,415 | 7/1985 | Alway | 377/92 |

FOREIGN PATENT DOCUMENTS 0078787 10/1982 European Pat. Off. .

*Primary Examiner*—John S. Heyman
*Attorney, Agent, or Firm*—Robert W. Becker & Associates

[57] ABSTRACT

An electrochemical counting device in a casing, which contains counters that may be switched by a drive. The drive is connected to a switch armature, which engages a stepping wheel to shift the counters. The drive is also provided with two swivel arms, which are not mechanically connected. Each swivel arm is equipped with a spool. In order to shift the counters, both swivel arms are pivotable oppositely directed in a synchronized manner, perpendicular to the pole face of the permanent magnet. The permanent magnet is arranged between the two swivel arms. Both swivel arms are supported at the casing by a spring. The swivel arms cannot be pivoted accidentally towards each other due to impact and therefore cannot accidentally shift the counters. The electromechanical counting device may therefore be employed, where sudden impact or magnetic interference may occur.

17 Claims, 4 Drawing Sheets

ELECTROMECHANICAL COUNTING DEVICE WITH UNINTENTIONAL COUNT PREVENTION STRUCTURE

BACKGROUND OF THE INVENTION

The present invention relates to an electromechanical counting device in a casing, which contains counters that may be switched by a drive. The drive comprises a permanent magnet and a spool which is disposed at a swivel arm. The swivel arm is connected to a switch armature, which actuates a stepping wheel to shift the counters.

In the known electromechanical counting device (EP-OS 00 787 87), the spool is arranged in the magnetic field of two permanent magnets which are attached to the casing. This known counting device, however, is not secured against external impact. Upon impact, the swivel arm may be unintentionally pivoted and thereby cause a counting run. Also, in the presence of external magnetic fields during the counting run, the swivel arm may be stopped so that the counting device does not work properly.

It is therefore an object of the present invention to provide an electromechanical counting device, which is protected against impact and is not functionally impaired by magnetic influences

Brief Description of the Drawings

This object, and other objects and advantages of the present invention, will appear more clearly from the following specification in conjunction with the accompanying drawings, in which.

SUMMARY OF THE INVENTION

The electromechanical counting device of the present invention is primarily characterized by an additional second swivel arm, which is not mechanically connected to the first swivel arm and is equipped with a spool. Both swivel arms for the shifting of the counters are pivotable in a synchronized oppositely directed movement perpendicular to the pole face of the permanent magnet, whereby the permanent magnet is arranged between the swivel arms. The swivel arms are supported by a spring action at said casing.

In the electromechanical counting device of the present invention, in order to actuate a counting run, the two swivel arms, which each carry a spool (electromagnetic coil), must be pivoted in a synchronized oppositely directed movement, perpendicular to the pole face of the permanent magnet. Such a synchronized oppositely directed pivoting action may not occur upon impact, because both swivel arms are not mechanically connected but are supported by a spring action at the casing. Thereby it is assured that the swivel arms cannot be accidentally pivoted in a synchronized oppositely directed movement due to impact and cannot actuate a counting run. Also, an external magnetic influence does not cause the swivel arm to stall during a counting run.

Description of Preferred Embodiments

The present invention will now be described in detail with the aid of several specific embodiments utilizing FIG. 1 through 6.

Figure 2:
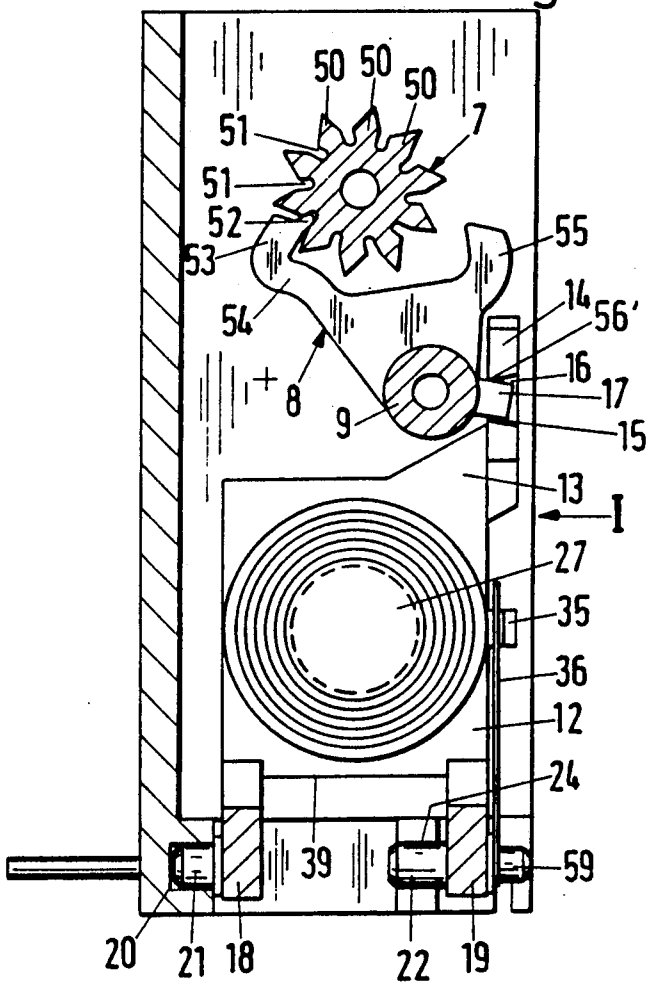
FIG. 2 is a cross-sectional view along the line II—II in FIG. 1.
Figure 4:
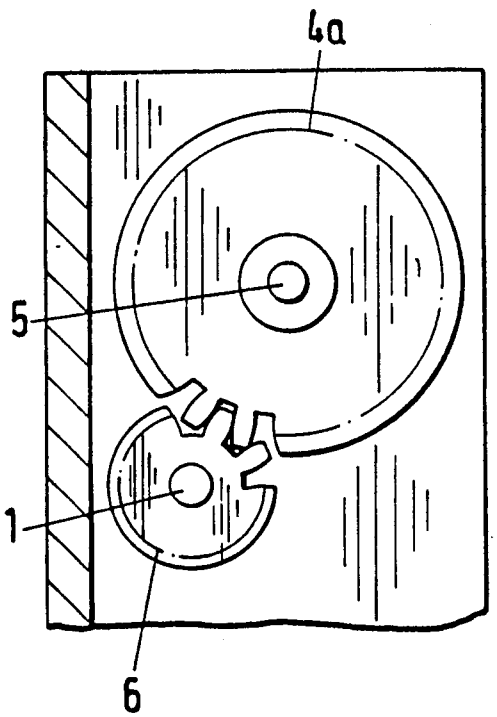
FIG. 4 is a view along the arrow IV in FIG. 3.
Figure 3:
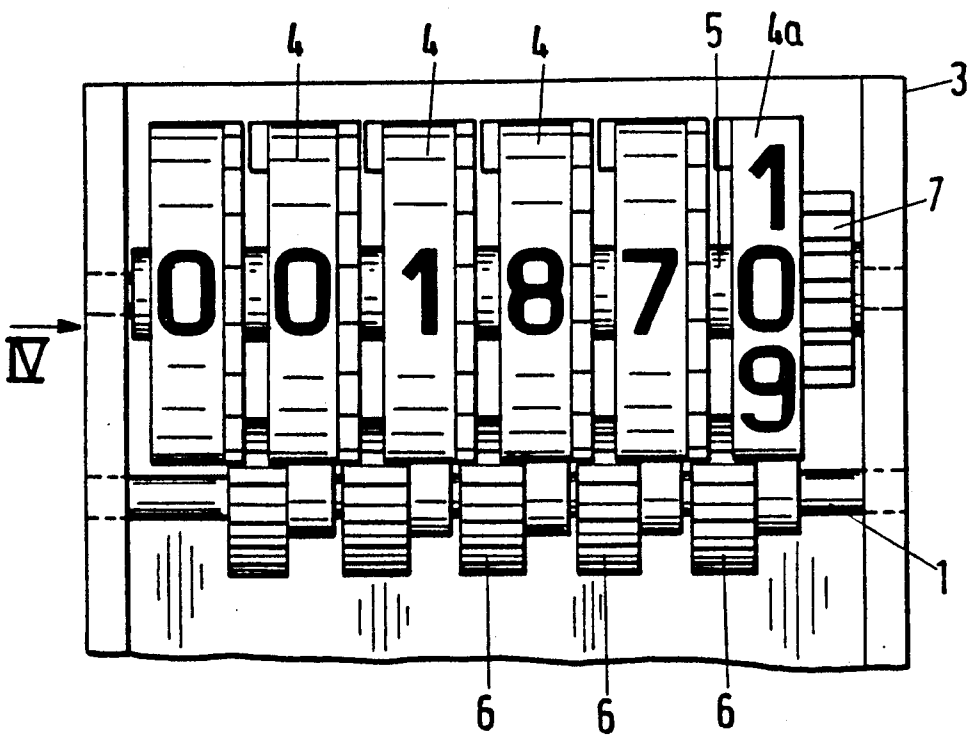
FIG. 3 is a view of the counters and the driving wheels of the counting device of the present invention according to FIG. 1.

The electromechanical counting device has a casing 3, which contains the drive 2 for the counters 4. As shown in FIGS. 3 and 4, the counters 4 are positioned next to each other in a conventional manner on a spindle. The neighboring counters 4 engage driving wheels 6, which are positioned on a spindle 1, parallel to the spindle 5. Both spindles 1 and 5 are supported at the walls of the casing 3. The driving wheels 6 conventionally drive the neighboring counters 4. The drive connection between the drive 2 and the counters 4 is also achieved in a conventional manner via a stepping wheel 7 positioned on the spindle 5. The stepping wheel 7 is attached in a fixed manner to the neighboring counter 4*a*. A switch armature 8 engages the stepping wheel 7 (FIGS. 1 and 2), whereby the switch armature 8 is connected in a fixed manner to the switch shaft 9 Preferably, the switch shaft 9 and the switch armature 8 are formed as an integral part. The switch shaft 9 is drivingly connected to the swivel arms 10 and 11 of the drive 2. This particular driving connection will be explained in detail in the following paragraphs. The switch shaft 9 is pivotable along an axis through the spindle 9*a*, which is also supported at the walls of the casing 3 and is parallel to the spindles 1 and 5.

Figure 1:
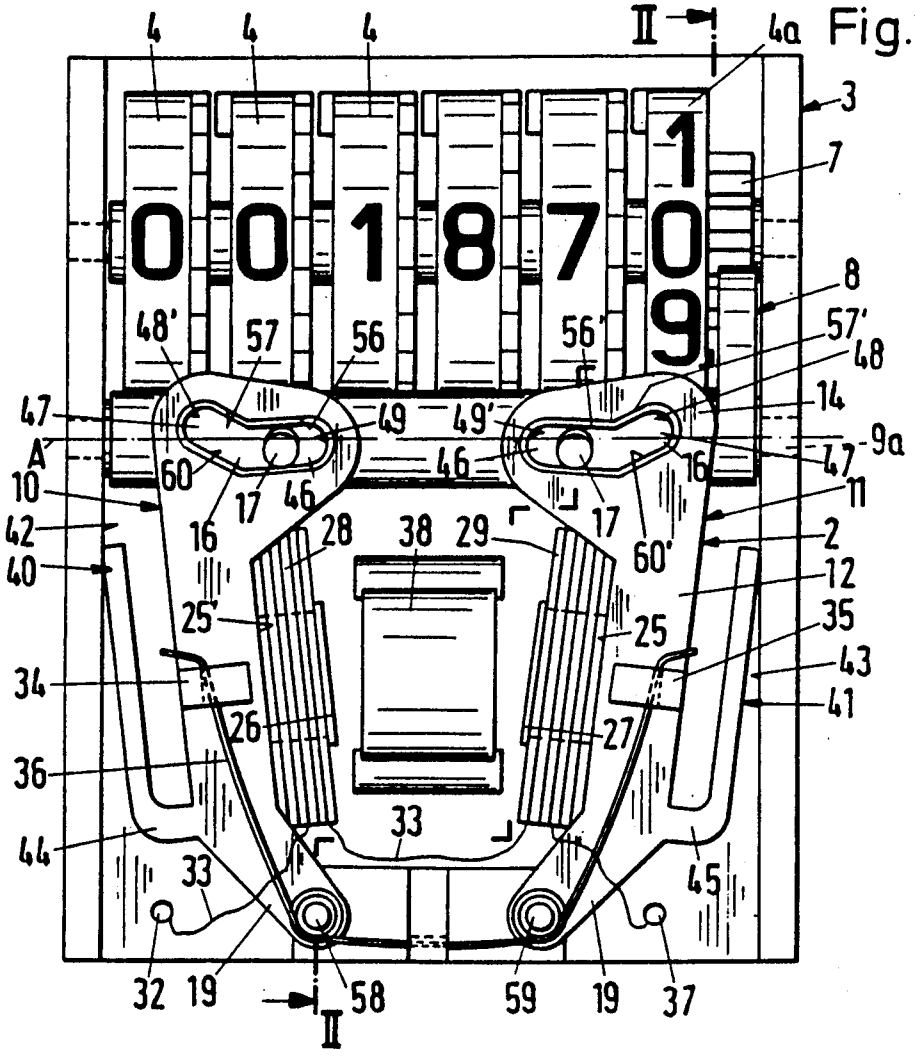
FIG. 1 is an electromechanical counting device according to the present invention in a view along the arrow 1 in FIG. 2.

The swivel arms 10 and 11 are arranged in a mirror inverted manner. Therefore, only one of the swivel arms, 11, will be described further. The swivel arm 11 comprises a nearly rectangular plate 12 (FIG. 2), which is vertical to the spindles 1, 5, and 9*a*, and has a triangular extension at its corner section 13 which is opposite the bottom of the casing 3 (FIG. 2). The face of the triangular corner extension 13 has a widened end section 14 (FIG. 1), which is preferably formed as an integral part of the plate 12. The end section 14, in a face view as shown in FIG. 1, is shaped as a triangle with rounded corners and, with its upper part, extends upward past the plate 12 in the direction of the counters 4 (FIG. 2). Immediately above the upper edge 15 of the triangular corner extension 13 (FIG. 2) there is provided an opening in the form of a plug aperture in the form of a sliding pin bracket 16, in which a plug part in the form of a sliding guide pin 17 of the switch shaft 9 engages.

The swivel arm 11 is equipped with two shackles 18 and 19 (FIG. 2), which are spaced parallel from each other and each have a alignment pin 21 and 22 on the side facing the bottom 62 of the casing 3. The alignment pins 21 and 22, which are perpendicular to the spindles 1, 5 and 9*a* and engage in pinning holes 20 and 24, form pivoting axes, perpendicular to the spindles 1, 5 and 9*a*, for the swivel arm 11.

Figure 6:
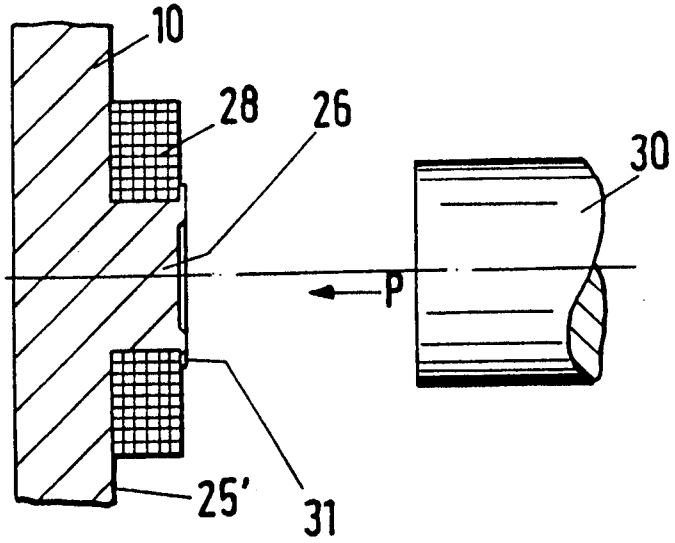
FIGS. 5 and 6 are cross-sectional views of the attachment of a spool on a swivel arm of the counting device according to the present invention.
Figure 5:
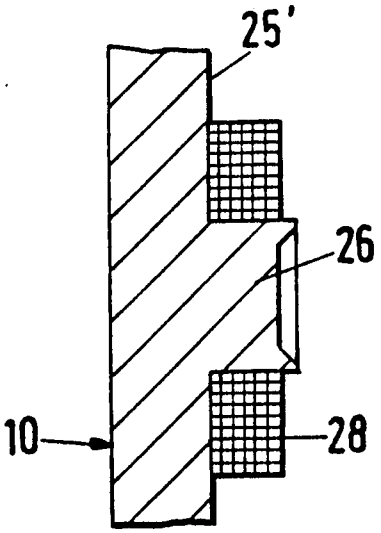

As shown in FIG. 1, the opposing sides 25 and 25' of the swivel arm plates 12 are each provided with a preferably cylindrical extension 26 and 27, preferably centered. The extensions 26 and 27 carry the spools or electromagnetic coils 28 and 29. As shown in FIGS. 5 and 6 for the swivel arm 10, the spool 28 is riveted onto the extension 26. The spool 28 is first arranged on the extension 26 such that it rests on the inside face of the plate 25 of the swivel arm 10. In this position the extension 26 extends somewhat past the spool 28. In a hot riveting step the protruding part of the extension 26 is then deformed with a stamp 30, so that the deformation 31 of the extension 26 overlaps the spool 28 and thereby securely fastens the spool onto the swivel arm.

In the presented, preferred embodiment the spools 28 and 29 are connected in series. From a connecting pin 32 (FIG. 1) the coil wire 33 leads to the spool 28, then to the spool 29 and finally to the connecting pin 37. This spool arrangement is advantageous because the spools become low resistant.

In another embodiment the two spools 28 and 29 are connected in parallel, whereby a thinner coil wire and more turns of the coil wire are required.

Figure 2A:
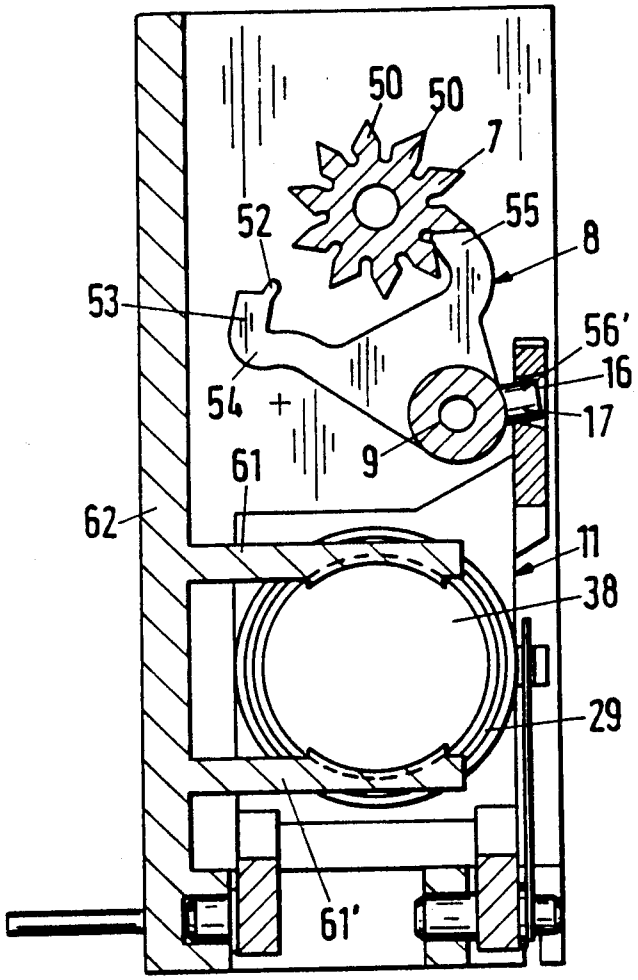
FIG. 1*a* and 2*a* demonstrate the shifting position of the counting device according to FIGS. 1 and 2.

As shown particularly in FIGS. 1 and 2*a*, a permanent magnet 38, which is held by supports 61 and 61' extending perpendicular to the back wall 62 of the casing 3, is arranged between the spools 28 and 29. When the two spools are excited, they are attracted the permanent magnet 38 in a synchronized oppositely directed movement (FIG. 1*a*), whereby a shifting step is actuated and the respective counter 4 is turned. The shifting of the counter 4 or 4*a* is only possible when both swivel arms 10 and 11 are pivoted in a synchronized oppositely directed movement. This embodiment assures high impact resistance of the electromechanical counting device. The simultaneous pivoting of the swivel arms 10 and 11 in a synchronized oppositely directed movement due to impact is impossible, because the direction of an impact acts only unilateral. Even a very strong impact does not result in an accidental shifting of the counting device.

Figure 1A:
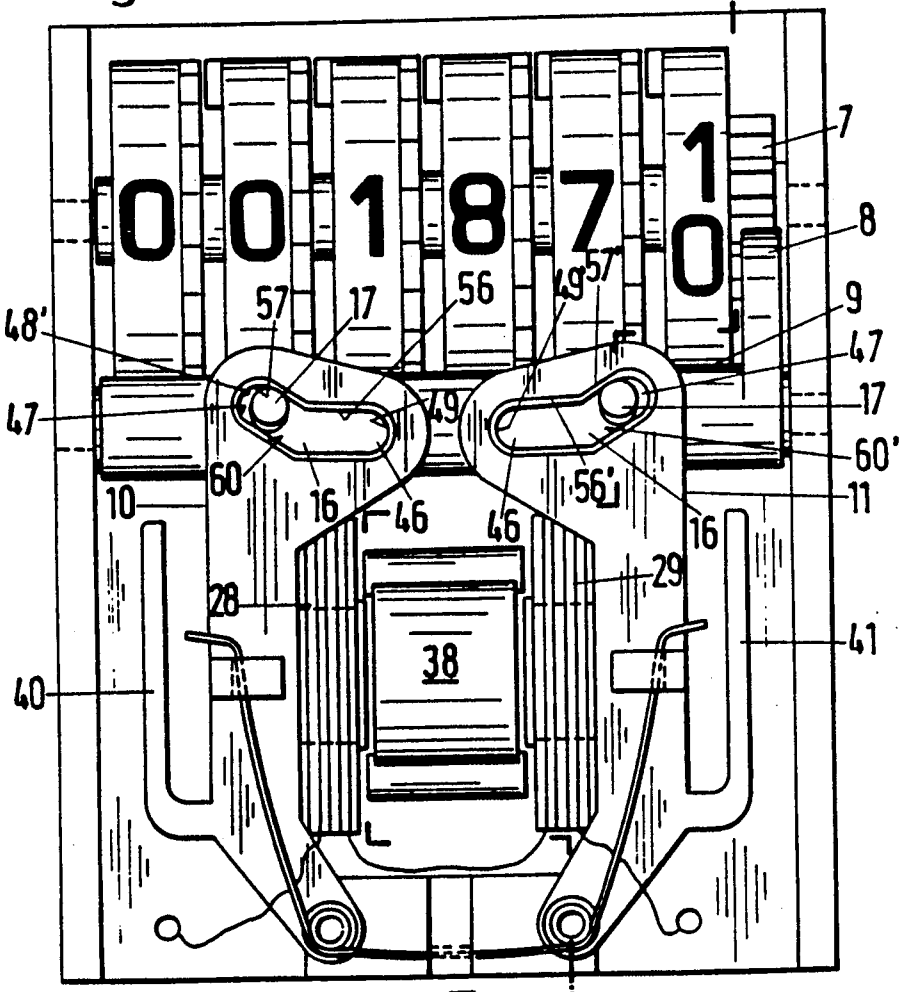

The two swivel arms 10 and 11 are equipped with springs 40 and 41 (FIG. 1) on the sides facing away from each other. The free ends of the springs 40 and 41 rest on the adjacent inner casing walls 42 and 43, when the counting device is in its resting position, and are distanced from the inner casing walls 42 and 43 during the counting run of the counting device (FIG. 1*a*). The springs 40 and 41 are preferably flat bars, which connect to the plate 12, preferably to its lower edge 39 (FIG. 2), via an intermediate piece 44 and 45 perpendicular to the springs 40 and 41. The springs 40 and 41 and the rectangular plate 12 of the swivel arms 10 and 11 are preferably formed as an integral part and extend approximately over the full length of the rectangular plate 12, so that they have high elasticity. The springs 40 and 41 assure that the swivel arms 10 and 11 are not accidentally pivoted to induce a counting run upon impact. Without the springs 40 and 41, an impact on the left casing wall would cause the right swivel arm 11 to pivot to the left, while the left swivel arm 10, due to the rebound effect, would pivot to the right (FIG. 1). Both swivel arms thereby pivot in a synchronized oppositely directed movement and cause a counting run. Due to the springs 40 and 41 such an accidental pivoting action is impossible. If an external impact occurs, the springs 40 and 41 absorb the impact or the external thrust by elastic deformation, so that an accidental oppositely directed movement of the swivel arms 10 and 11 does not occur.

The spring 36 acts on the two swivel arms 10 and 11 oppositely directed, so that the swivel arms 10 and 11 are forced away from each other whereby the springs 40 and 41 are pressed against the adjacent casing walls. The swivel arms 10 and 11 are each equipped with an L-shaped catch 34 and 35 on the sides facing away from the bottom 62 of the casing 3. The ends of the spring 36 are suspended in the catches 34 and 35 which are open in the direction in which they face each other, so that the spring may be easily mounted. The spring is U-shaped (FIG. 1) and leads from the catches 34 and 35 to the guide bolts 58 and 59, which are arranged on the face of the shackless 19, opposite the alignment pins 22 and are flush with them (FIG. 2). The single spring 36 thereby acts on both swivel arms 10 and 11 in the direction of their resting position (FIG. 1). The free ends of the spring 36 are preferably bent in opposite directions from each other, so that an accidental slipping of the spring from the catches 34 and 35 is reliably avoided.

The sliding pin brackets 16 of the swivel arms 10 and 11 each have sections 46, which run approximately parallel to the longitudinal middle axis A of the spindle 9*a* and transmutes into a section 47 which is at an obtuse angle to the section 46. Since the end sections 14 of the swivel arms 10 and 11 extend past the inner sides 25, 25' of the rectangular plate 2 towards each other (FIG. 1), and the sliding in brackets 16 may be formed a sufficient length to assure a reliable shifting in the tilted section 47 or to reliably prevent an accidental shifting in the approximately parallel section 46. The tilted sections 47 are connected to the ends of the approximately parallel sections 46 of the sliding pin brackets 16, which are facing away from each other. The sections 46 and 47 are approximately of the same length.

As shown in FIGS. 1, 2 and 1*a*, 2*a*, the sliding pin brackets 16 are beveled to become wider from the inner switch shaft side 9 outward, preferably in a continuous manner. In the initial position (FIG. 1) the sliding guide pins 17, preferably formed in the shape of cylindrical bolts, are positioned in the axis parallel sections 46 of the sliding pin bracket 16. The sliding guide pins 17 are spaced from the adjacent section ends 49, 49' of the sections 46. This is advantageous, because a sufficient distance for the pivoting action of the swivel arm 10 and 11 is assured when an impact occurs on the counting device. The swivel arms 10 and 11 may pivot this distance between the end sections 49, 49' and the sliding guide pins 17 in the direction of the adjacent casing walls. As long as the sliding guide pins 17 are inside the sections 46, the switch shaft 9 is not rotated and neither is the switch armature, accordingly no counting run takes place.

Only when the sliding guide pins 17 reach the area of the tilted sections 47 of the sliding pin bracket 16 (FIGS. 1*a* and 2*a*). is the switch shaft 9 rotated by the pivoting swivel arms 10, 11. Thereby the switch armature 8, which is connected to the switch shaft 9 in a fixed manner, preferably as an integral part of the switch shaft 9, engages the stepping wheel 7, and the counters 4, 4*a* are rotated in a conventional manner.

Since the sliding guide pins 17 are guided in the sliding pin bracket 16, close tolerances in the manufacture as well as in the assembly of the swivels arms 10 and 11 and he switch shaft 9 must be achieved. To assure a simple assembly and a secure shifting the stepping wheel 7 is of a particular shape. Between the adjacent teeth 50 of the stepping wheel 7, recesses 51 are provided which are radially arranged (FIG. 2), into which the finger-like extension 52 at the free end 53 of the claw arm 54 engages. Depending on tolerances, the extension 52 of the switch armature 8 may engage more or less closely between the teeth of the stepping wheel 7.

Thereby an exact shifting of the stepping wheel 7 is provided independent of the tolerances in manufacture and assembly. The fingerlike extension 52 is only provided at one claw arm. The other claw arm 55 is not provided with such an extension, because, after the shifting step (FIG. 2*a*), the claw arm 55 rests securely at the respective tooth 50 of the stepping wheel 7, due to the contact of the sliding guide pin 17 at the lower edge 60, 60' of the tilted section 47.

When the two swivel arms 10 and 11 are pivoted towards each other for the shifting step and the claw arm 55 rests at the respective tooth 50 of the stepping wheel 7, whereby the counter 4 is shifted accordingly, the sliding guide pins 17 still are spaced from the ends 48, 48' of the tilted section 47 (FIGS. 1*a*, 2*a*). This also allows for the compensation of tolerances in manufacture and/or assembly of the swivel arms.

The tilted sections 47 of the sliding pin bracket 16 are tilted such, that the pivoting of the swivel arms 10 and 11 towards each other is sufficient to rotate the switch shaft 9 about the spindle 9*a* so that the switch armature 8 may accordingly rotate the stepping wheel 7 for the shifting step.

In the initial position of the swivel arms 10 and 11 (FIG. 1), in which the spools 28, 29 are not excited, the sliding guide pins 17 of the switch shaft 9 rest on the edge 56 56', which faces away from the spools, in the axis parallel sections 46 of the sliding pin bracket 16 (FIG. 2). It is shown in FIG. 2 that in the initial position the sliding guide pins 17 are arranged with a small distance from the lower edge 56' of the axis parallel section 46. Since the axis parallel sections 46 become continuously wider in the direction away from the switch shaft 9 and the sliding guide pins 17 are formed as cylindrical bolts, they have only a small linear contact with the edge 56 of the sections 46. When the spools 28 29 are excited and the swivel arms 10 and 11 pivot towards each other accordingly, the sliding guide pins 17 are moved into the tilted sections 47, in which they rest on the edges 60, 60' which are facing the spools 28, 29 (FIG. 1*a*, 2*a*). Since the sections 47 are positioned in a tilted manner to the axis of the switch shaft 9, the switch shaft 9 is rotated by the sliding guide pins 17 in the tilted sections 47 when the swivel arms 10 and 11 are pivoted towards each other, so that the switch armature 8 carries out the described pivoting action to rotate the stepping wheel 7. As soon as the stepping wheel 7 has been rotated sufficiently, the swivel arms 10 and 11 are pivoted outward in a synchronized oppositely directed movement, whereby the switch shaft 9 is first stalled. After a short pivoting distance of the swivel arms 0 and 11, the edge 57, 57', facing away from the spools 28, 29, of the sections 47 comes in contact with the sliding guide pins 17 of the switch shaft 9, so that during the further pivoting action of the swivel arms 10 and 11 the switch shaft 9 is rotated back into its initial position, as shown in FIG. 1.

The present invention is, of course, in no way restricted to the specific disclosure of the specification, examples and drawings, but also encompasses any modifications within the scope of the appended claims.

What we claim is:

1. An electromechanical counting device in a casing, which contains counter wheels that may be switched by a drive, comprising a permanent magnet and an electromagnetic coil, which electromagnetic coil is disposed on a first swivel arm which is connected to a switch armature which actuates a stepping wheel to shift said counter wheels; said counting device further comprising:

a second swivel arm, which is not mechanically connected to said first swivel arm and is equipped with a further electromagnetic coil both said swivel arms for the shifting of the counter wheels being pivotably mounted to perform a synchronized oppositely directed movement perpendicular to pole faces of said permanent magnet to actuate said stepping wheel;

said electromagnetic coils being respectively fastened on sides of said swivel arms that are facing one another for actuating said swivel arms in said synchronized oppositely directed movement;

said permanent magnet being fastened to said housing between said swivel arms at a location between said electromagnetic coils; and a spring means being provided at said swivel arms for preventing unintentional switching of said counter wheels, said spring means resting at said casing and loading said swivel arms in a direction of said synchronized oppositely directed movement.

2. An electromechanical counting device according to claim 1, in which said spring means is an integral part of said swivel arm in the form of a projection extending between said swivel arms and said casing.

3. An electromechanical counting device according to claim 1, in which said swivel arms engage a switch shaft of said switch armature, which switch shaft and said switch armature are connected in a fixed manner and which switch shaft is rotatable about a spindle, which spindle is attached to the casing.

4. An electromechanical counting device according to claim 4, in which said switch shaft and said switch armature are formed as one integral part.

5. An electromechanical counting device according to claim 3, in which said switch shaft is connected to said swivel arms by a plug connection and said switch shaft has at least two plug parts, which extend into respective apertures of said swivel arms.

6. An electromechanical counting device according to claim 5, in which said apertures become wider in the radial direction away from said switch shaft.

7. An electromechanical counting device according to claim 5, in which said plug apertures have a first slot section, which is approximately parallel to said spindle of said switch shaft, and a second slot section, which is tilted at an angle to said spindle of said switch shaft.

8. An electromechanical counting device according to claim 7, in which a longitudinal axis of said first slot sections is disposed approximately at the same height as a longitudinal axis of said switch shaft, and a longitudinal axis of said second tilted slot sections is disposed at an obtuse angle to said longitudinal axes of said first slot sections.

9. An electromechanical counting device according to claim 8, in which said longitudinal center line of said first slot sections is disposed somewhat below said longitudinal axis of said switch shaft.

10. An electromechanical counting device according to claim 8, in which said obtuse angle is approximately 145°.

11. An eleotromechanical counting device according to claim 1, in which said swivel arms are mirror inverted to each other and are spring actuated in an oppositely directed movement away from each other, with respect to their initial positions.

12. An electromechanical counting device according to claim 7, in which in an initial position of said swivel arms prior to a counting process, said plug parts of said switch shaft are resting at upper rims of said first slot sections; and, during shifting of said switch armature, are resting in said second slot sections, and make contact on lower edges of said second slot sect ions, when said swivel a-ms are pivoted.

13. An electromechanical counting device according to claim 1, in which a claw arm of said switch armature is provided with a protruding stepping wheel; and said stepping wheel has teeth and between said teeth radially arranged recesses, which recesses engage said extension of said switch armature.

14. An electromechanical counting device according to claim 1, in which said swivel arms have hub-like extensions as supports for said electromagnetic coils, which supports are formed as an integral part of said respective swivel arm.

15. An electromechanical counting device according to claim 14, in which said electromagnetic coils are riveted on said supports.

16. An electromechanical counting device according to claim 14, in which said electromagnetic coils are hot riveted on said supports.

17. An electromechanical counting device according to claim 1, in which said electromagnetic coils are connected in series.

* * * * *